United States Patent [19]

Dodero

[11] Patent Number: 4,753,547

[45] Date of Patent: Jun. 28, 1988

[54] DEVICE FOR APPLYING AND DISTRIBUTING SHAVING FOAM ON THE FACE

[76] Inventor: Marcelo L. Dodero, Rojas 303 - 7°"A", Buenos Aires, Argentina

[21] Appl. No.: 921,742

[22] Filed: Oct. 22, 1986

[30] Foreign Application Priority Data

Oct. 22, 1985 [AR] Argentina ..... 302026

[51] Int. Cl.[4] ..... A46B 11/02

[52] U.S. Cl. ..... 401/190; 401/288

[58] Field of Search ..... 401/190, 288; 222/402.13

[56] References Cited

U.S. PATENT DOCUMENTS

| | | | |
|---|---|---|---|
| 2,849,737 | 9/1958 | Piccinini et al. | 401/190 X |
| 2,897,526 | 8/1959 | Dootson . | |
| 3,032,803 | 5/1962 | Walshauser . | |
| 3,093,857 | 6/1963 | Hersh . | |
| 3,116,403 | 12/1963 | Carter . | |
| 3,299,465 | 1/1967 | Dykes . | |
| 3,346,908 | 10/1967 | Johnson | 401/190 |
| 3,350,159 | 10/1967 | Rice, Jr. | 401/190 |
| 3,351,418 | 11/1967 | Karnuth . | |
| 3,363,968 | 1/1968 | Williams . | |
| 3,370,908 | 2/1968 | Cupp | 401/190 |
| 3,388,840 | 6/1968 | Hug | 222/402.13 |
| 3,388,958 | 6/1968 | Modla . | |
| 3,408,151 | 10/1968 | Cleghorn . | |
| 3,450,313 | 6/1969 | Jonas | 222/402.13 |
| 3,565,541 | 2/1971 | Vallis | 401/190 X |
| 3,609,050 | 9/1971 | Alexander | 401/190 |
| 3,611,820 | 10/1971 | Hemple | 222/402.13 X |
| 3,981,597 | 9/1976 | Cohn | 401/190 |
| 4,348,126 | 9/1982 | Nigro | 401/288 X |
| 4,636,102 | 1/1987 | Drake | 401/190 |

FOREIGN PATENT DOCUMENTS

| | | | |
|---|---|---|---|
| 4891 | 2/1932 | Australia | 401/288 |
| 852410 | 9/1970 | Canada . | |

*Primary Examiner*—Steven A. Bratlie

*Attorney, Agent, or Firm*—Scully, Scott, Murphy & Presser

[57] ABSTRACT

A device for dispensing and applying shaving foam to the face from an aerosol container comprising a circular body and an obliquely extending discharge arm which terminates in a natural hair applicator brush. The discharge arm extends from the circular wall and is attached to a support disk which activates the aerosol valve to dispense foam. The arm has a conduit of increasing cross-section disposed internally for transporting the dispensed foam to the applicator brush. The discharge outlet of the conduit is located at point between the ends of the brush hairs and the mounting surface of the hairs and acts with the increasing cross section of the conduit to prevent the destruction of the foam bubbles during facial application.

10 Claims, 6 Drawing Sheets

Fig. 3
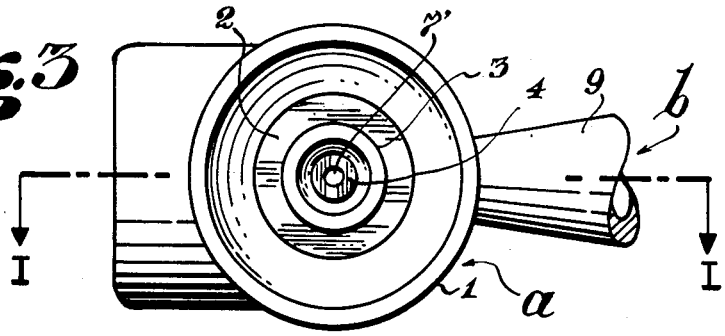
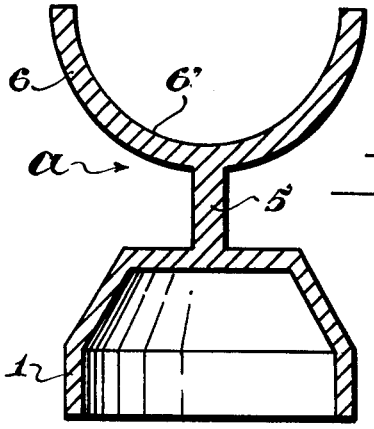
Fig. 4
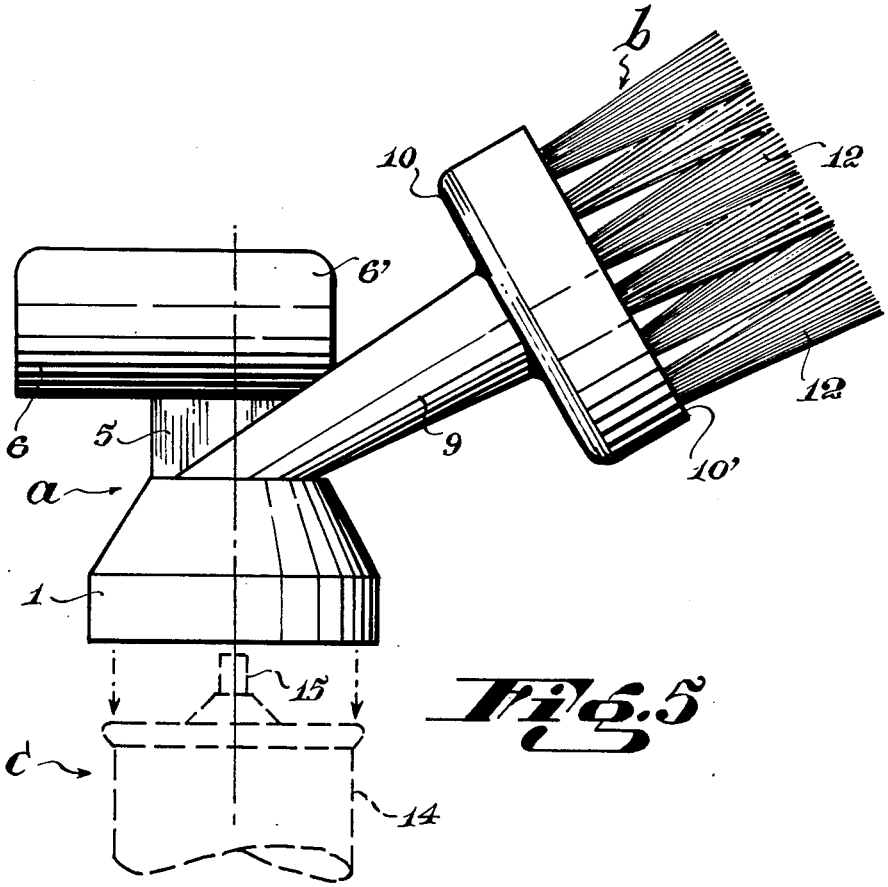
Fig. 5

Fig. 6
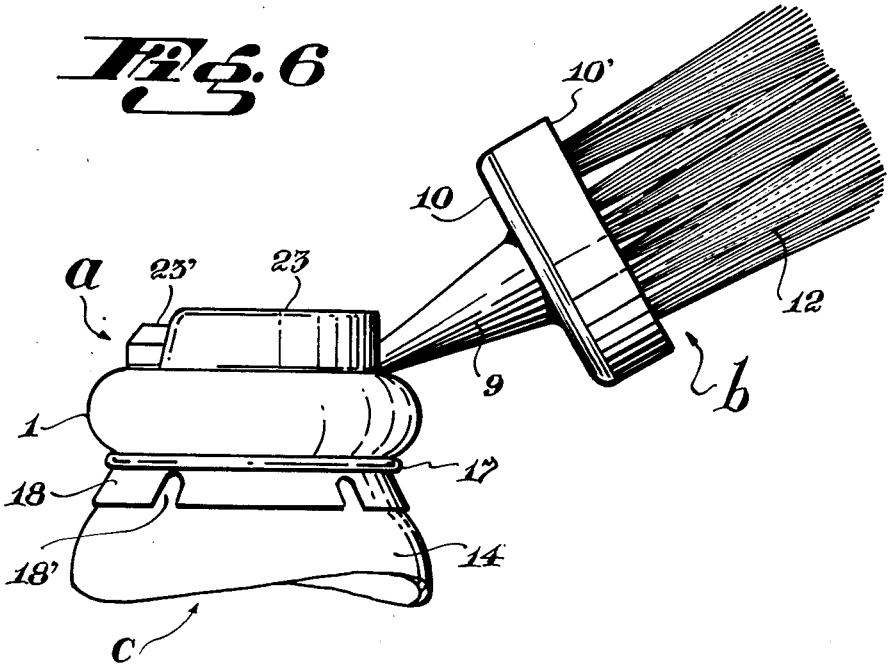
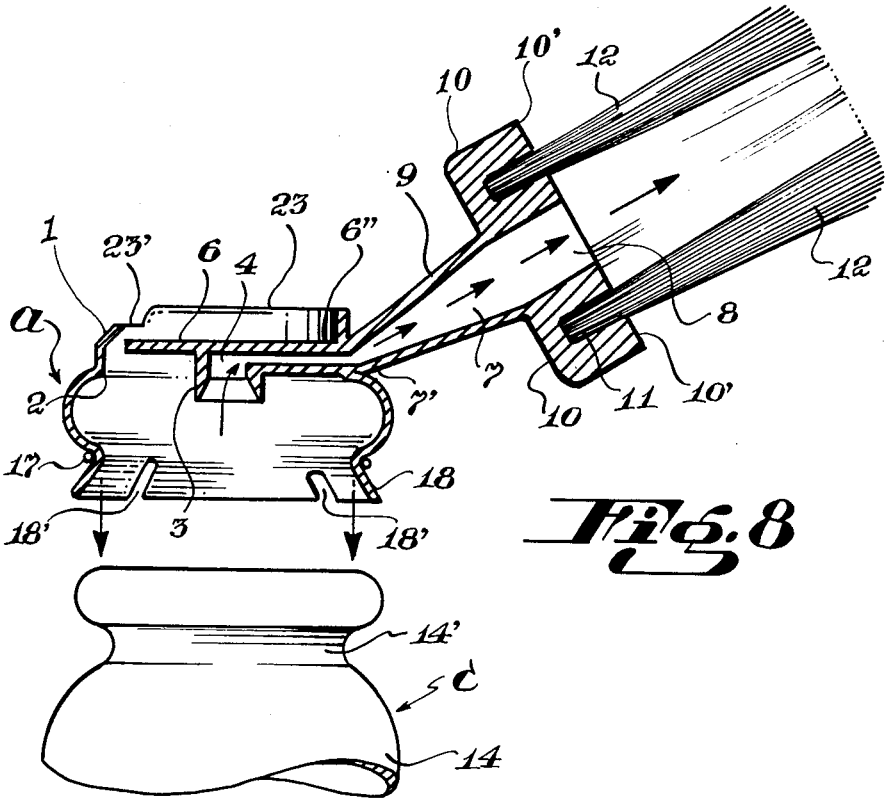
Fig. 8

Fig. 13
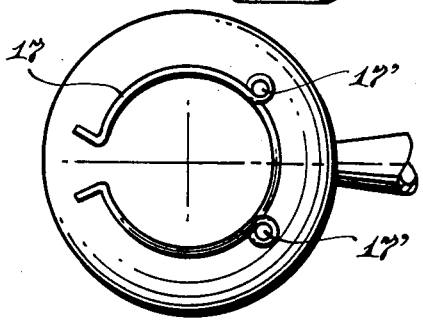
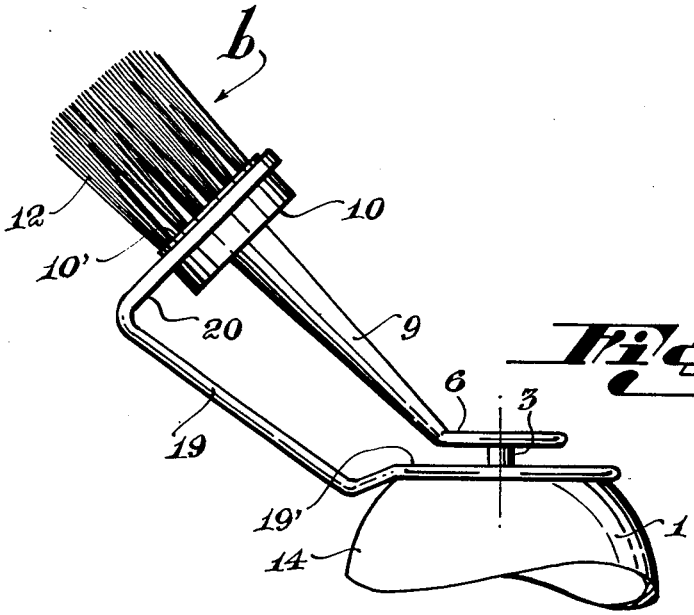
Fig. 14
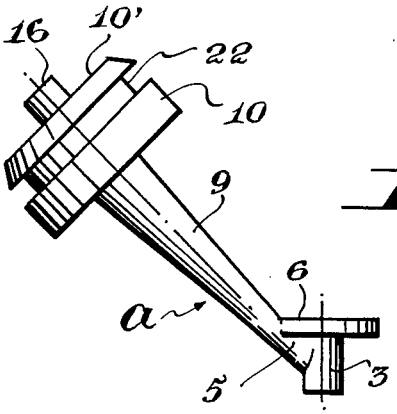
Fig. 15

DEVICE FOR APPLYING AND DISTRIBUTING SHAVING FOAM ON THE FACE

This invention relates to a device for applying and distributing shaving foam on the face and is intended to produce a highly practical means which, connected to the discharge valve of an aerosol container of shaving foam or the like, noticeably facilitates the operation of said valve and makes the foam dose pass through a shaving brush to apply and distribute said product.

Practical inconveniences resulting from the use of aerosol containers in the delivery of shaving foam are already known.

In effect, when shaving himself, the user must discharge a dose of foam on the palm of his hand, using his hand to distribute the foam.

Obviously, such practice is not the most suitable manner of application, since pressure exerted by the hand on the face, while holding the dose of foam, tends to destroy the bubbles forming said foam and, therefore, to make it less effective in softening the beard.

Likewise, this manual method of application is rather uncomfortable, as it does not allow the adequate and uniform distribution of the foam on the face surface as a shaving brush would, and since the hand must be washed after each application, there is the consequent waste of the product.

In order to overcome such problems, some means have appeared in the market, which combine the aerosol discharge of foam through a conduit that makes the foam pass towards the distribution brush, said devices having certain inconveniences at a great or minor extent, as heretofore particularly analyzed in each case.

The invention referred to in this specification provides a positive solution to existing problems by means of a device for applying and distributing shaving foam on the face, said device being of the kind that, connected to the discharge valve of an aerosol container of shaving foam, constitutes the intermediate pushing means for driving said valve, and comprises a conduit for foam discharge, connected as an extension of the valve discharge opening itself.

According to this invention, and in one form of embodiment, said device is characterized in that it comprises a body crowned with a concave pushing means aligned with the center of the valve coupling and which, as from said coupling, has a tubular arm laterally projected, which is provided with a head where the hairs of a distributing brush are anchored, said brush allowing the application of foam in a manner as soft as in the case of paint.

The longitudinal conduit of this longitudinal arm is of variable section, which is minimal at the area of valve coupling and maximal at the opposite area, corresponding to the outlet of a discharge nozzle.

This discharge nozzle, which is surrounded by the hairs of the distributing brush, has its outlet disposed at an intermediate area between anchor and crests of said hair, respectively.

According to said embodiment, many advantages and aims are intended by this invention, the most important being that of forming a perforated head acting as anchor base of the plurality of hair bunches forming the brush and which surround the discharge opening of the foam outlet conduit or path, so that said product is delivered just at the center of said brush.

Another object of the invention is to extend the foam outlet conduit or path beyond the anchor base of filiform elements forming the brush, by projecting a nozzle which outlet is contained in a plane between said anchor base and the crests of the filiform elements so that, when discharged, the foam does not spread through the hair bunch.

Another object of this invention is to provide a pushing means accurately aligned with the center of the valve coupling of the valve itself, while the longitudinal geometric axis of said pushing means is within a plane ideally crossing the center of said valve, so that said valve is coaxially driven, thus avoiding an irregular operation thereof and deficiences that will eventually make it useless.

A further object of the invention is to provide U-shaped pushing means having a concavity for digital anatomic adjustment, which allows a more secure operation.

Another object is to form the foam outlet conduit or path with a variable section which, as from the minimum section corresponding to the coupling area, is gradually increased towards the outlet, where the maximum section is achieved. The gradual spreading of the foam is thus secured without risk of having bubbles destroyed.

Another object of the invention is to provide a brush comprising filiform elements formed by natural hair such as goat or skunk hair, etc., which prevents the soap from sliding which would occur if artificial filaments were used-and, at the same time, and on account of the hair flexibility, it further prevents the brush from breaking the bubbles of the foam mass.

Another object of this invention is to arrange the body of valve coupling, pushing means, tubular arm and head in a single part, which, apart from simplifying the manufacture and assembly of the system, allows operation with a much firmer control means, as no relative displacements are likely to occur among component parts.

Another object of the invention is to form, around the valve coupling, lateral walls in the form of a socket telescopically mounted on the head and lateral walls of the aerosol container, which allows it to direct a smoother operation.

Another object is to provide a brush which, having its anchor in an area of annular strip around the discharge nozzle, is formed by hair bunches which are joined in the upper part corresponding to their crests, a system of compact hair being thus formed.

Another object of the invention is to provide the head of hair anchor with an intermediate annular groove disposed between said anchor and the discharge nozzle, as cooling means of the piece to be produced. It is to be noted that since a single piece is involved, this refrigeration increases possibilities of production thereof.

Moreover, another object of the invention is the fact that the tubular arm forming the head and the discharge conduit are obliquely directed to the valve coupling and the longidutinal geometric axis of the aerosol container, with which they form an obtuse angle, whereby the brush is directed upwards, application and distribution of the product on the face being thus facilitated without need of inclining the container.

Another object is to provide a universal coupling to the valve base, which allows adjustment of the device to different kinds of foam aerosol containers.

A further object of the invention is to provide the possibility of arranging the brush hairs in a mechanized manner, which not only allows a greater reduction of costs, but also secures a uniform integration of the different bunches of filiform elements.

Another object of the invention is to provide a coupling means between the device and the valve head of the aerosol container of foam, which, in its different variations, defines a positive anchor, whereby said device can be firmly operated, as if it were an indivisible part of said container.

Likewise, the system can be arranged in more than one piece (e.g. two or three), which can be reciprocally coupled with each other in an adequate manner, so as to provide a highly practical and harmonious structure, specially suitable for the fulfilment of its specific purposes. This integration of more than one piece, combined to each other, advantageously allows the use of different materials such as, for example, plastic, aluminum, etc., and provides the advantages of each of them for different purposes, either for strength, structure or esthetics.

In addition, other advantages and purposes arise from this invention, which will be made evident in the foregoing specification.

Regarding state of the art and differences between prior art and this invention, the following patents of invention can be cited:

(a) Canadian Patent of Invention No. 852410:

This patent does not disclose a head disc -like the one proposed here- but a ring. The boxing shape of this ring requires the presence of discharge openings to allow the outlet of condensations, which does not occur in this invention.

The pushing means is not adapted to the finger, nor is it arranged as indicated in this invention.

The head lacks the intermediate cooling groove and is not provided with a plurality of anchor perforations of hair bunches, but with a continuous groove tending to make the anchor less secure, so that hairs can be released.

The discharge opening is not extended beyond the projection plane where hairs are anchored, so that, as said plane is not projected, the opening allows the discharged foam to spread over the area adjacent the hairs.

Both the valve coupling and the outlet channel form a right angle (not obtuse as proposed) so that application of foam on the face is much more difficult and obliges to incline container and device until a "tilted" position is obtained for certain applications, such as, for example, when foam is delivered to be applied under the chin.

In addition, no guiding socket is formed on the container top. The discharge conduit is of constant section.

(b) U.S. Pat. No. 3,363,968:

The invention does not include hair bunches but teeth or tines, which, apart from working in a different manner, produce irritation.

The discharge conduit is of constant section.

The invention is arranged in several pieces.

The invention lacks the head place for anchoring filiform elements or hair, simply because it also lacks the latter.

There is no intermediate cooling groove.

The discharge groove lacks any projection in the form of a nozzle.

No socket is formed on the container, as it is mounted thereon in a non-movable manner.

(c) U.S. Pat. No. 3,376,095:

The invention simply refers to a shaving brush which is mounted on the aerosol container by a coupling means corresponding to said container and a constant section conduit for foam outlet.

The invention keeps no similarity at all with this invention.

(d) U.S. Pat. No. 3,093,857:

The invention refers to a shaving brush overlapping, through a support, an aerosol valve operating in alignment with said brush.

There is no essential similarity with the invention proposed in this application.

(e) U.S. Pat. No. 3,351,418:

Except for the fact that adjustment to the valve peak can be considered universal, there is no essential similarity with the embodiment of this invention, since said patent simply refers to a shaving brush with a coupling to the valve peak, which operates in a coaxial relation thereto and distributes the foam among the brush hair.

(f) U.S. Pat. No. 3,350,159:

The invention comprises no plate head used as anchor of the brush hair.

In addition, the invention lacks a cooling groove.

No brush is formed, but a nozzle with an indented end.

The discharge conduit is not directed to an oblique position with respect to the longitudinal geometric axis passing through the container valve, but it forms a right angle therewith.

The invention fails to form a single piece from applying means, pushing means and valve coupling.

(g) U.S. Pat. No. 3,346,908:

The invention simply refers to a detachable shaving brush-holder, which allows to fasten the shaving brush in alignment with the discharge peak.

There is no essential similarity with the object proposed in this invention.

(h) U.S. Pat. No. 3,338,958:

There is no essential similarity with the object proposed, as the invention is similar to that proposed in U.S. Pat. No. 3,346,908, except in that this case refers to a shaving brush disposed in alignment with a longitudinal geometric axis of the container, so that the foam discharge is made through a thin rolled conduit, which necessarily tends to break the bubbles.

(i) U.S. Pat. No. 3,370,908:

The invention does not include the tubular arm supporting a head related to an anchor of hair bunches.

The invention lacks any pushing means of digital adjustment, aligned with the center of the valve, for which reason, said valve must be laterally operated.

There is no nozzle projecting the discharge beyond the plane of hair root or anchor, so that, when discharged, foam spreads through said roots.

The invention provides no hair bunches but a continuous ring at the anchor of said hairs.

(j) U.S. Pat. No. 3,408,151:

The invention refers to a simple shaving brush having a conduit for discharge of contents, directly disposed on its own shaft.

The invention has nothing in common with the object proposed in this application.

(k) U.S. Pat. No. 2,849,737:

The only element in common with the present invention lies in the fact that the pushing means is aligned with the center of the valve. However, said pushing means does not correspond to a single-pieced structure, nor has it any digital anatomic adjustment, which is projected with a tubular arm of variable section in its longitudinal channel. Said pushing means is not integrated to a disc head with cooling groove, nor does it allow the mounting of hair bunches thereon, etc.

Therefore, there is no important constitutive similarity between both embodiments.

(l) U.S. Pat. No. 3,032,803:

The invention refers to an applying plate formed by a soft piece, which does not have hair but ridges or stubs, among which foam passes through a chamber ending in a channel of constant section.

The pushing means constitutes no single piece and belongs to the aerosol and, furthermore, it lacks any digital anatomic adjustment.

No brush is formed, and the place is not disposed in an obtuse angle with the container, but in a right angle. No outlet nozzle is provided, as in this invention, but the foam outlet discharge is placed on the plane of stub roots.

Though the outlet conduit seems to gradually increase as from the valve coupling, in fact, no conduit is provided but a chamber, which outlet is formed by an oblique channel of constant section.

(ll) U.S. Pat. No. 3,299,465:

The invention refers to another simple case where the shaving brush is mounted on a foam aerosol container, as disclosed in U.S. Pat. No. 3,351,418.

Therefore, there is no substantial similarity with the object proposed in this invention.

(m) U.S. Pat. No. 2,897,526:

The invention refers to an applying means having a small pad or sponge to which foam coming from the valve of an aerosol container is directed through a conduit of constant section.

Except for the fact that the applying means and the center of the valve form an obtuse angle, this patent has no similarity at all with the proposed invention.

(n) U.S. Pat. No. 3,116,403:

The invention does not refer to a device applicable in common aerosol container of shaving foam, but to a mechanism whereby part of the device itself is formed by an applying means in the form of a shaving brush.

Therefore, the above invention keeps no similarity with the proposed object which, in addition, allows a detachable anchor which proves to be highly safe and makes the system -from the functional point of view- operate as the object of U.S. Pat. No. 3,116,403, as it allows a firm control thereon. This system further provides the advantage of being releasable, as it is not subordinated to a single aerosol container of the foam (which would obviously make it considerably expensive). For that reason, once the contents of the container are used up, the system can be detached from said container and then mounted on a full container.

Having analyzed the present state of the art, the proposed invention is now below described.

In order to more clearly define and understand the object of the invention, the same is illustrated by means of several figures representing it, in one of the preferred forms of embodiment, all of which is presented as an enumciative and non-limitative example, namely:

FIG. 3 is a bottom view of the device, which shows the socket of telescopic adjustment to the container top, and the valve coupling.

FIG. 4 is a section view according to plane IV—IV indicated in FIG. 1, which specially shows the U-shaped concavity for anatomic adjustment of the pushing means, and the coaxial position thereof with respect to the center of the value coupling.

FIG. 5 is a side view of the device.

FIG. 6 is a side view of the device in a new form of embodiment, according to which a new anchoring means is formed between said device and the neck of the aerosol container of the shaving foam, by means of the use of an elastic contracting means, such as a tempered wire, like spring

FIG. 8 is a diametral (longitudinal) sectional view of the device, according to a line indicated as VIII—VIII in FIG. 7, which gives a clear idea of the structure of the body, as provided with the annular contracting spring, the manner in which the device is mounted on the container being also indicated by the arrows.

FIG. 13 is a bottom view of the device partially shown with a new form of embodiment comprising the contracting annular spring, which can be affixed to the body by means of rivers or the like through loops formed by the same wire.

FIG. 14 is a side view of the device in a new form of embodiment, formed by two basic pieces positively related to each other, where one of said pieces can be a metal support and the other the system comprising the brush, its tubular arm and the pushing device for operating the device, and, finally, FIG. 15 is a side view of the plastic single piece, which, in the embodiment of FIG. 14, forms the shaving brush (still without hairs), said tubular arm and the pushing means.

In the different figures, the same reference numbers indicate equal or corresponding parts, the group of several elements being indicated with letters.

Figure 1:
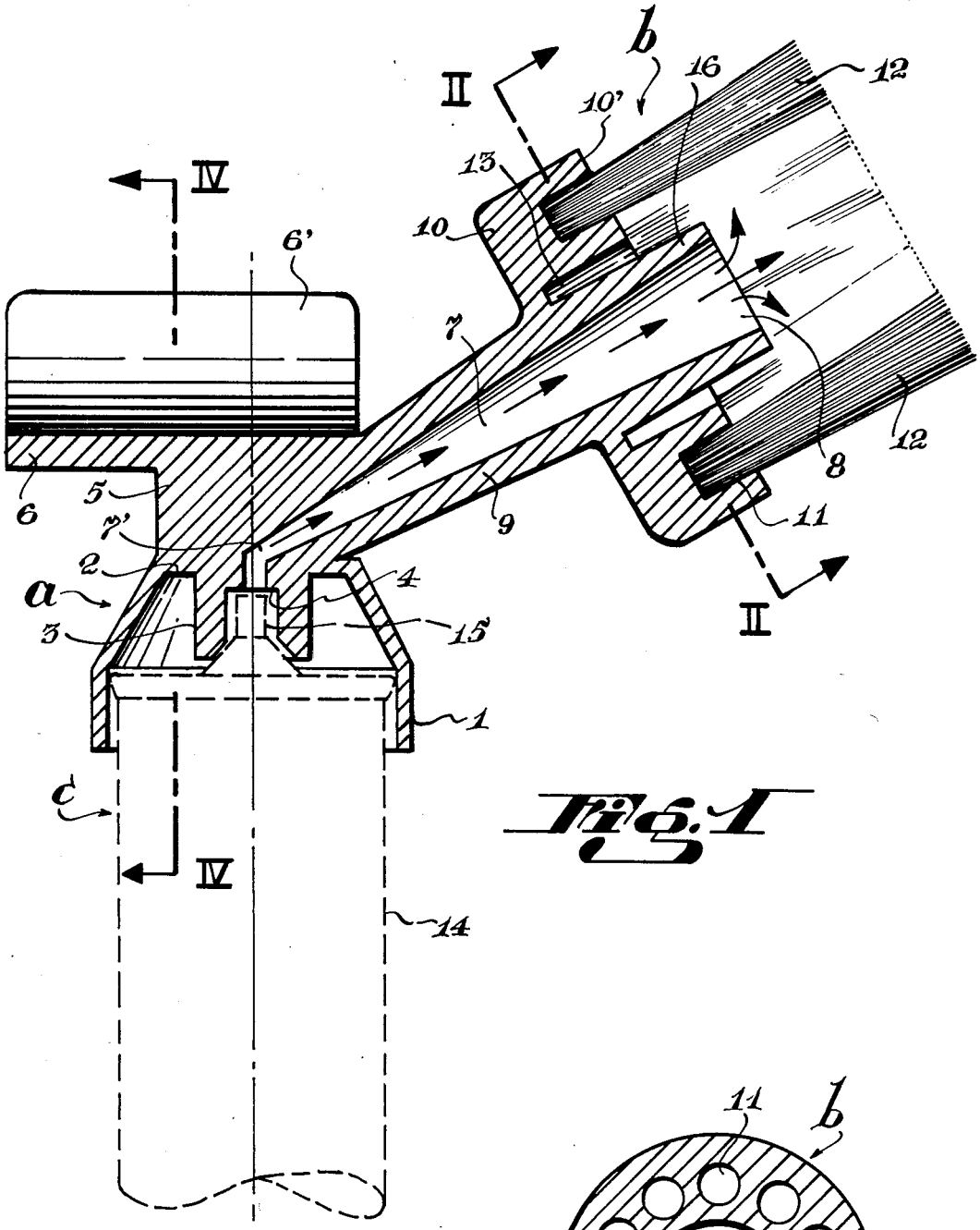
FIG. 1 is a longitudinal sectional view of the device, which shows the general single-pieced constitution thereof and the arrangement of the different parts forming the same.

In general, a is the applying device formed by a single piece of plastic material or like adequate material, which comprises a body 3 forming a valve coupling 4 and an inner wall 2 where walls 1 have their lateral origin, said walls 1 forming a socket which covers valve peak 15 and the top of walls 14 corresponding to aerosol container c, which contains the aerosol shaving foam (FIG. 1).

From wall 2, piece a, by means of link 5, is integrally crowned with pushing means 6, which is formed by a U-piece which branches determine an elongated cavity 6' being the receptacle of digital anatomic adjustment (FIGS. 1 and 4).

This pushing means 6, thus arranged with cavity 6', has the characteristic of being exactly aligned with the center of the valve coupling 4, and with the center of valve peak 15 once the device a is mounted on container c (FIG. 1).

Figure 2:
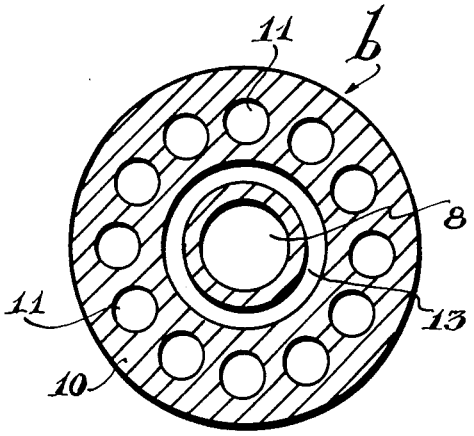
FIG. 2 is a front view of the head with perforations without hairs, which shows the presence of an annular groove acting as cooling means.
Figure 7:
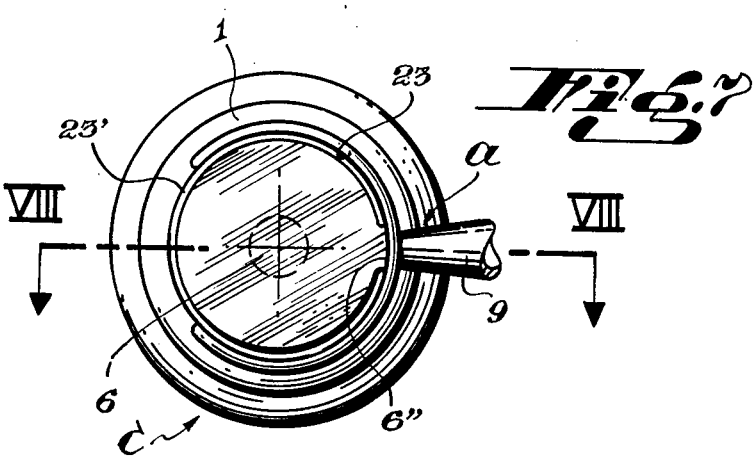
FIG. 7 is a planar view of the device according to FIG. 6.

From the same wall 2, and as extension of link 5, single piece a laterally projects a tubular arm 9 forming a circular head plate 10, which is of constant thickness and is delimited by a main face or plane 10', on which multiple perforations 11 are disposed on a same ideal annular strip surrounding the longitudinal conduit 7, this conduit affecting said tubular arm 9 (FIG. 2).

This tubular arm 9 extends beyond plane 10' and forms nozzle 16, which outlet 8 appears over 10'.

Longitudinal conduit 7 is approximately a conic-trunk of variable section, where the minimum section 7' results from the area adjacent valve coupling 4 in body 3; while maximum section of said conduit 7 corresponds to outlet 8 of nozzle 16.

Bunches of hair 12 are anchored in the inner part of perforations 11, said hair bunches being spaced from each other in the anchor area of plate 10, but they come into contact at their crests at the opposite upper area, a practically continuous distribution area being thus formed.

Outlet 8 of nozzle 16 is included within a plane between face 10' of plate 10 and the plane formed by the crests of projected hairs 12. Thus, when passing through conduit 7, shaving foam projects towards crests without spreading over bunches of hair 12 at the anchor area of plate 10 and areas adjacent plane 10'.

Likewise, as a single piece is involved, head plate 10 has been provided, between perforations 11 and nozzle 16 with an annular groove 13 as means for cooling the piece resulting from the process of production (FIGS. 1 and 2).

Gradual variation of cross section of conduit 7, between valve coupling 4 (minimum cross at section 7') and outlet 8, makes shaving foam passing again gradually spread without causing the final breaking of bubbles thereof, as in the case of a discharge channel of constant section or of inverted reduction with respect to the indicated one.

As a single piece is involved, and since pushing means 6 is perfectly aligned with the longitudinal geometric axis of valve peak 15, and valve coupling 4 (FIGS. 1, 3 and 4) causes a firm and secure operation and prevents common fluctuations tending to bend or deteriorate valve peak 15, while, at the same time, it noticeably simplifies the process of production.

Accordingly, when the user's finger rests on concavity 6' of pushing means 6, while container c and device a are held with only one hand, valve peak 15 bends and, when pressed on by coupling 4, it allows the flow of shaving foam which passes through conduit 7 and gradually spreads until reaching outlet 8 of nozzle 16, and then penetrates among hairs 12 of brush b which allows the uniform distribution thereof.

These hairs 12 are highly flexible and smooth, on account of their natural origin, such as goat hair, skunk hair, or the like. Soap foam is thus prevented from sliding among hairs and, by virtue of the high flexibility of the hair, a uniform distribution of the foam is allowed, which neither irritates the skin, nor breaks the foam bubbles.

It is to be noted that the longitudinal geometric axis of the tubular arm 9 and head plate 10 carrying brush b form an upward obtuse angle with respect to longitudinal geometric axis of valve coupling 4 and container c (FIGS. 1 and 5), which noticeably facilitates the operation of facial application and distribution.

Embodiments of FIGS. 6 to 14 show some different structural embodiments of the device, which are firmly mounted on the foam aerosol container, by adequate anchor means 17 and 18 below described, and illustrate possible forms of structural embodiments of the system, in two, three or more pieces, said pieces being also of different material with respect to each other, in order to achieve a functionally adequate, esthetic and resistant format.

Thus, according to the embodiment of FIGS. 6 to 9, and 12, the socket or body 1 and inner wall 2 thereof have an externally annular convex format for adjustment to the equivalent format of the head surrounding valve 15, surrounding the container c for application (FIGS. 10 and 11), and at the upper part, and in the form of small railing they have an annular rim 23 surrounding pushing means 6 as to protect it, but to which the user has access (for operation thereof) through a front notch 23' on said railing or rim 23 (FIGS. 6 to 8 and FIG. 12). In addition, in the case of embodiments such as the one of FIG. 12, said rim 23, at the area diametrally opposite to notch 23', can be provided with another notch 23'' to allow engagement of tubular arm 9.

In the embodiment of FIGS. 8, 9, 12, 14 and 15 pushing means 6 is formed by a plate which integrally constitutes an inter-communication conduit between conic conduit 7 of said tubular arm 9, and the body 3 corresponding to coupling valve 4 (FIG. 8), and is articulably connected to the body or socket 1, by a bridge 6'' acting as articulation link of said pushing means 6, which is then separated from internal parameters of body 1 by an open annular separation.

Therefore, when said pushing plate 6 is pressed with the finger introduced through notch 23', the displacement of valve 15 is produced and foam enters conduit 7 through coupling 4 and then flows among hairs 12 of brush b, in the already described manner, and as indicated by arrows appearing in FIG. 8.

Figure 11:
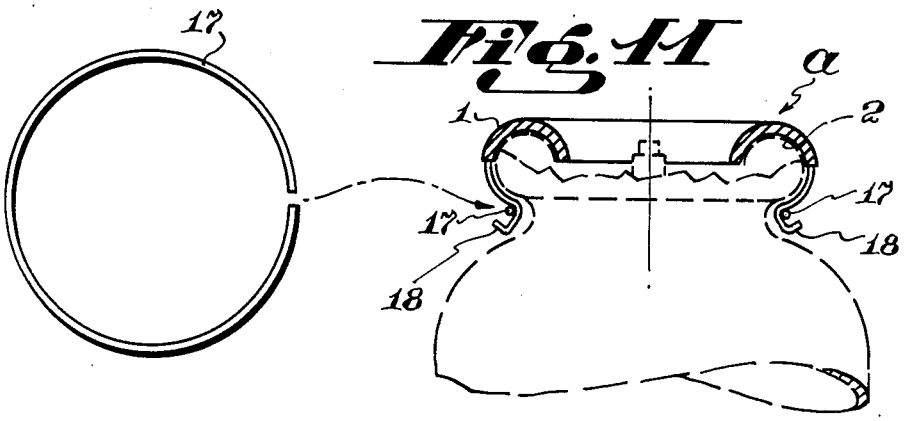
FIG. 11 is a diametral sectional view corresponding to the anchor system between the device and the container, by means of the contracting wire spring, which also appears separated and in its front part, so as to show the structure thereof.

Regarding the anchor between device a and container c, body 1 is extended by means of a structure elastic in itself, or which in a surrounding concavity includes an annular spring 17, made of steel wire, which can be detachable (as indicated in FIG. 11) or affixed by rivets or the like, through loops 17' formed by the same spring 17, as shown in the embodiment of FIG. 13.

Figure 9:
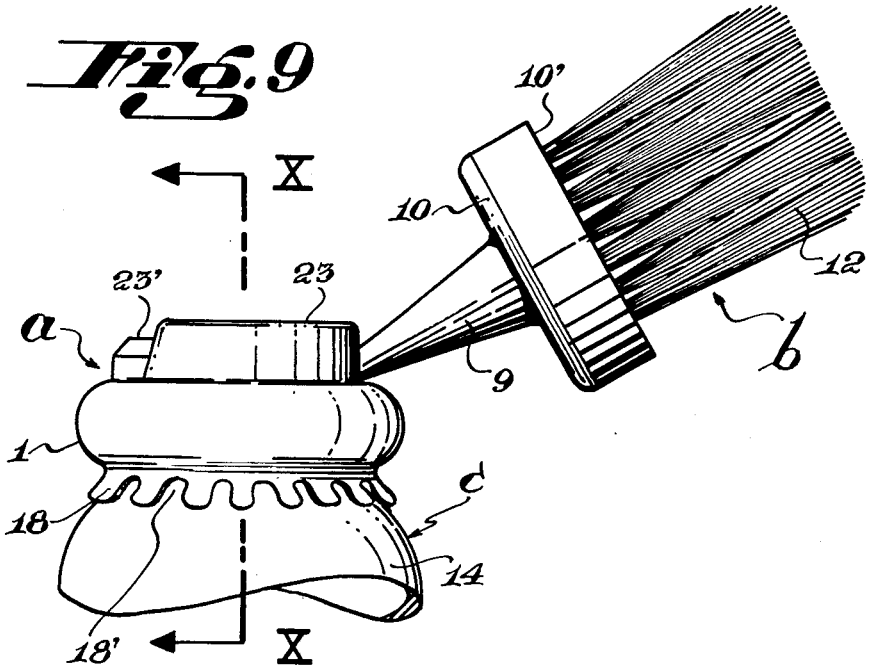
FIG. 9 is a new form of embodiment of the body of said device, which is made of plastic and completed with a contracting skirting, preferably of metal sheet, acting as a coupling means with respect to the neck of the container.
Figure 10:
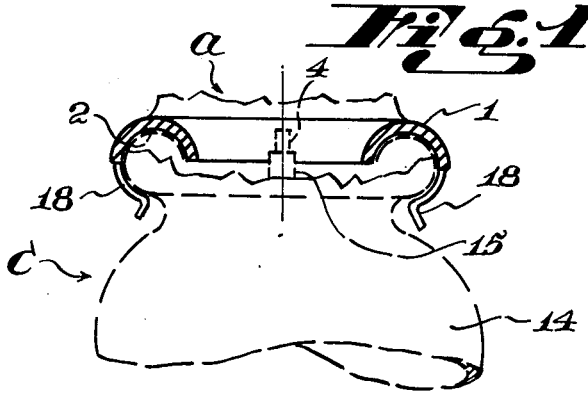
FIG. 10 is a section detail of the device according to plane X—X indicated in FIG. 9, which specifically shows anchoring and supporting means with respect to the head edge and the neck of the container.

In FIG. 6 (with detail in sectional view of FIG. 8), the lower projection of body 1 embraces neck 14' of the foam aerosol container, and comprises a skirting 18, which, in the case of FIGS. 9 to 11, is made of metal (steel) and has a diameter inferior to that corresponding to neck 14' of container c, but is elastically yielding. Thus, a reciprocal adjustment is provided, with a contracting effect with respect to skirting 18 against neck c of container 14, such effect being supported by the presence in this skirting 18 of at least three equidistant openings 18' at 120° C. with respect to each other and, preferably, the presence of the open annular spring 17, which must be detachable as in FIGS. 6 to 8, or fixed as in FIG. 13.

Likewise, device a with brush b is also arranged to have a structure not only of a single piece as in FIGS. 1 to 5, but in two, three or more pieces as well, said pieces being connectable to each other and even of different nature or material.

Figure 12:
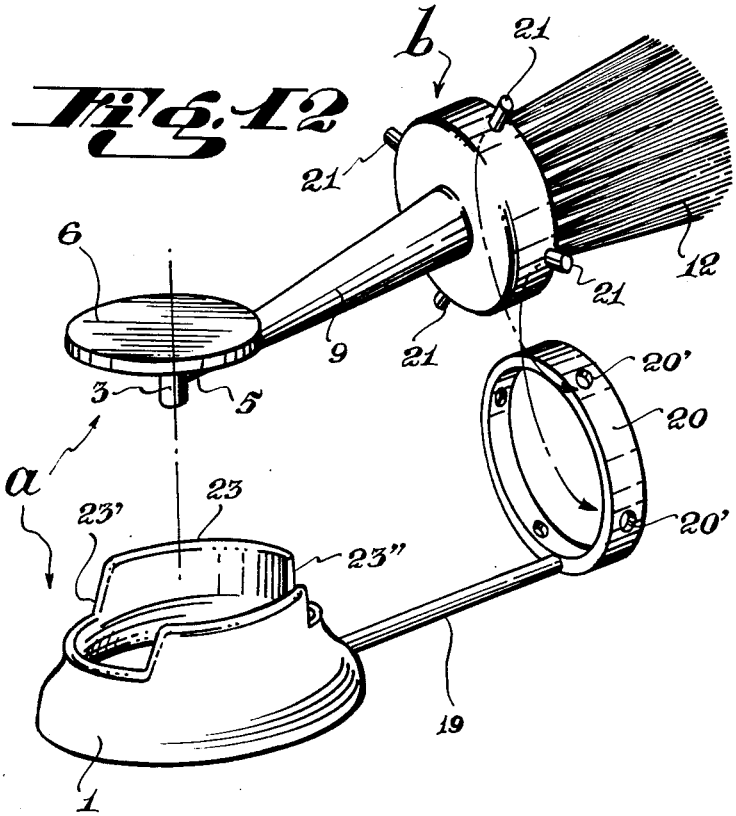
FIG. 12 is a perspective view of the device in a new form of embodiment, according to which the device is formed by two basic pieces, which are coupled to each other; this figure does not show the anchor system used, which can be any system, such as any of the already described ones.

For example, in the embodiment of FIG. 12, body 1 has an integrally projected support 19, which ends in a ring, pin or the like 20 and has holes 20', while rim 23 has a notch 23'' towards the same direction.

On the other hand, plate pushing means 6 forms a plastic-injected single piece with the body of valve coupling 3 on reverse thereof the interconnecting tubular extension of conduit 7 of tubular arm 9, link 5 and head plate 10, whereon hair bunches 12 are mounted (either manually or by means of a machine). Tubular arm 9, in this case, has a length coinciding with that of support 19, while diameter of head plate 10 is slightly less than inner diameter of ring 20, and it laterally comprises a plurality of stubs 21, the number and position of which coincide with those of holes 20' of ring 20, to which they are fitted, both pieces being the linked as forming a same body (FIG. 12).

In the embodiment of FIGS. 14 and 15, brush b, with head plate 10, comprises a surrounding annular groove 22 (FIG. 15), where the pin or ring 20 of a support (which can be of metal) fitted, affixed to walls 14 by means of a portion 19' (FIG. 14).

There is no doubt that, as this invention is put into practice, some modifications may be made regarding certain details related to manufacture and form of the new device, which will not imply a deviation from the fundamental principles on which the foregoing claims are clearly based.

The nature of this invention and the manner in which the same is to be put into practice being thus specially described and determined, the exclusive right and title thereon is hereby claimed:

1. A device for facial application and distribution of shaving foam contained in an aerosol container, which is formed by a single element comprising a body with a circular wall which at its lower part has fixing means removable at the upper rim of the container, said wall having in its upper edge a conduit which radially projects from the center of the circular wall and extends beyond said wall and ends in a means for applying shaving foam, said conduit being joined to the edge of said wall by a minimal joining zone so as to allow alternating movement of the inner end of said conduit, said inner end of the conduit having supporting means for pressing it downwards from its normal resting position, the outlet of the inner end of said conduit having housing means for a foam discharge valve of the aerosol container so as to allow the opening and closing of the aerosol valve by alternating coaxial movement causing opening and closing of the valve, said conduit forming an angle of more than 90° C. with respect to the vertical axis of said housing means, and the cross section of said conduit increasing from said inner end until the outlet thereof in said applying means, so as to cause a continuous pressure drop of the foam discharged by the aerosol pressure, said applying means being formed by a lateral enlargement of the discharge conduit which forms a base having a thickness sufficient to form cavities for housing hair bunches fixed to said base by mechanical means, said discharge conduit extending beyond the cavities for housing said hair bunches, so as to discharge foam at a distance far from said base, thus avoiding lateral discharge of foam among said hair bunches, said hair bunches being natural and so flexible as to prevent the destruction of bubbles formed by the shaving foam and the aerosol.

2. A device for facial application and distribution of shaving foam contained in an aerosol container according to claim 1, wherein said discharge conduit extends through said circular wall at a portion thereof contained within said circular wall, and is provided with support means for pressing said discharge conduit downwardly from a normal resting position to discharge said foam.

3. A device for facial application and distribution of shaving foam contained in an aerosol container according to claims 1 or 2, wherein said support means comprises a disk having a diameter slightly smaller than the inner diameter of said circular wall.

4. A device for facial application and distribution of shaving foam contained in an aerosol container according to claim 3, wherein said disk has a portion of its perimetrical rim joined to said circular wall.

5. A device for facial application and distribution of shaving foam contained in an aerosol container according to claim 1, wherein the discharge conduit initially has a constant cross section portion at said inner end, said cross section increasing from said circular wall along its length until reaching the discharge outlet, so as to cause a continuous pressure drop of the foam discharged by the aerosol pressure in said increasing cross section portion.

6. A device for facial application and distribution of shaving foam contained in an aerosol container according to claim 1, wherein said lateral enlargement of the discharge conduit comprises a discoidal body around said discharge conduit having a surface adjacent the discharge outlet, said surface provided with a plurality of cavities equidistant from each other, the depth of cavities being sufficient to allow fixing of the hair bunches by mechanical means.

7. A device for facial application and distribution of shaving foam contained in an aerosol container according to claims 1 or 6, wherein said discharge conduit extends beyond the surface comprising said cavities for housing the hair bunches to a height sufficient to cover gaps between each hair bunch fixed to said cavities.

8. A device for facial application and distribution of shaving foam contained in an aerosol container according to claim 7, wherein said cavities for housing said hair bunches and the discharge conduit are partially separated at said enlargement zone by a circular groove extending therebetween.

9. A device for facial application and distribution of shaving foam contained in an aerosol container according to claim 1, wherein said natural hairs are approximately 80% skunk hair and 20% horse hair.

10. A device for facial application and distribution of shaving foam contained in an aerosol container according to claim 1, wherein said natural hairs are approximately 80% goat hair and 20% horse hair.

* * * * *